US008297356B2

(12) United States Patent
Balczewski

(10) Patent No.: US 8,297,356 B2
(45) Date of Patent: Oct. 30, 2012

(54) METHOD AND SYSTEM FOR PRODUCING HYDROCARBONS FROM A HYDRATE RESERVOIR USING A SWEEP GAS

(75) Inventor: John T. Balczewski, Danville, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 282 days.

(21) Appl. No.: 12/644,661

(22) Filed: Dec. 22, 2009

(65) Prior Publication Data

US 2010/0163246 A1 Jul. 1, 2010

Related U.S. Application Data

(60) Provisional application No. 61/141,877, filed on Dec. 31, 2008.

(51) Int. Cl.
*E21B 36/00* (2006.01)

(52) U.S. Cl. ..... 166/272.1; 166/303; 166/369

(58) Field of Classification Search ..... 166/268, 166/272.1, 303, 305.1, 369, 370
See application file for complete search history.

(56) References Cited

U.S. PATENT DOCUMENTS

| | | | | |
|---|---|---|---|---|
| 4,424,866 | A | 1/1984 | McGuire | |
| 6,214,175 | B1 | 4/2001 | Heinemann et al. | |
| 7,165,621 | B2 | 1/2007 | Ayoub et al. | |
| 7,198,107 | B2 | 4/2007 | Maguire | |
| 7,222,673 | B2 | 5/2007 | Graue et al. | |
| 7,343,971 | B2 | 3/2008 | Pfefferle | |
| 7,513,306 | B2 | 4/2009 | Pfefferle | |
| 7,546,880 | B2 | 6/2009 | Zhang et al. | |
| 2003/0051874 | A1 | 3/2003 | Munson et al. | |
| 2004/0200618 | A1 * | 10/2004 | Piekenbrock | 166/305.1 |
| 2005/0016725 | A1 | 1/2005 | Pfefferle | |
| 2005/0284628 | A1 | 12/2005 | Pfefferle | |
| 2008/0121393 | A1 | 5/2008 | Pfefferle | |
| 2008/0135257 | A1 | 6/2008 | Zhang et al. | |
| 2010/0000221 | A1 | 1/2010 | Pfefferle | |
| 2010/0132933 | A1 | 6/2010 | Nakamur et al. | |

FOREIGN PATENT DOCUMENTS

WO WO2008136962 11/2008

OTHER PUBLICATIONS

International Search Report and Written Opinion dated Jun. 25, 2010 for PCT Application No. PCT/US2009/069269.

* cited by examiner

*Primary Examiner* — Daniel P Stephenson
*Assistant Examiner* — Catherine Loikith
(74) *Attorney, Agent, or Firm* — Marie L. Clapp

(57) ABSTRACT

The present invention relates to a method and system for producing hydrocarbons from a hydrocarbon containing hydrate reservoir. The method includes providing at least one producer well in fluid communication with a producing facility and with a hydrocarbon containing hydrate reservoir. The hydrate reservoir is in fluid communication with a head space disposed above the hydrate formation. The head space contains disassociated hydrocarbons and water. A sweep gas is swept through the head space to remove the disassociated gas and water from the hydrate reservoir and to transport the disassociated gas and water to the at least one producer well. The additional pressure and/or heat provided by the sweep gas may help inhibit the reformation of disassociated gas and water into hydrates allowing for enhanced production rates. The additional heat will also help increase the disassociation rate of the upper part of the hydrate formation adjacent to the head space.

14 Claims, 1 Drawing Sheet

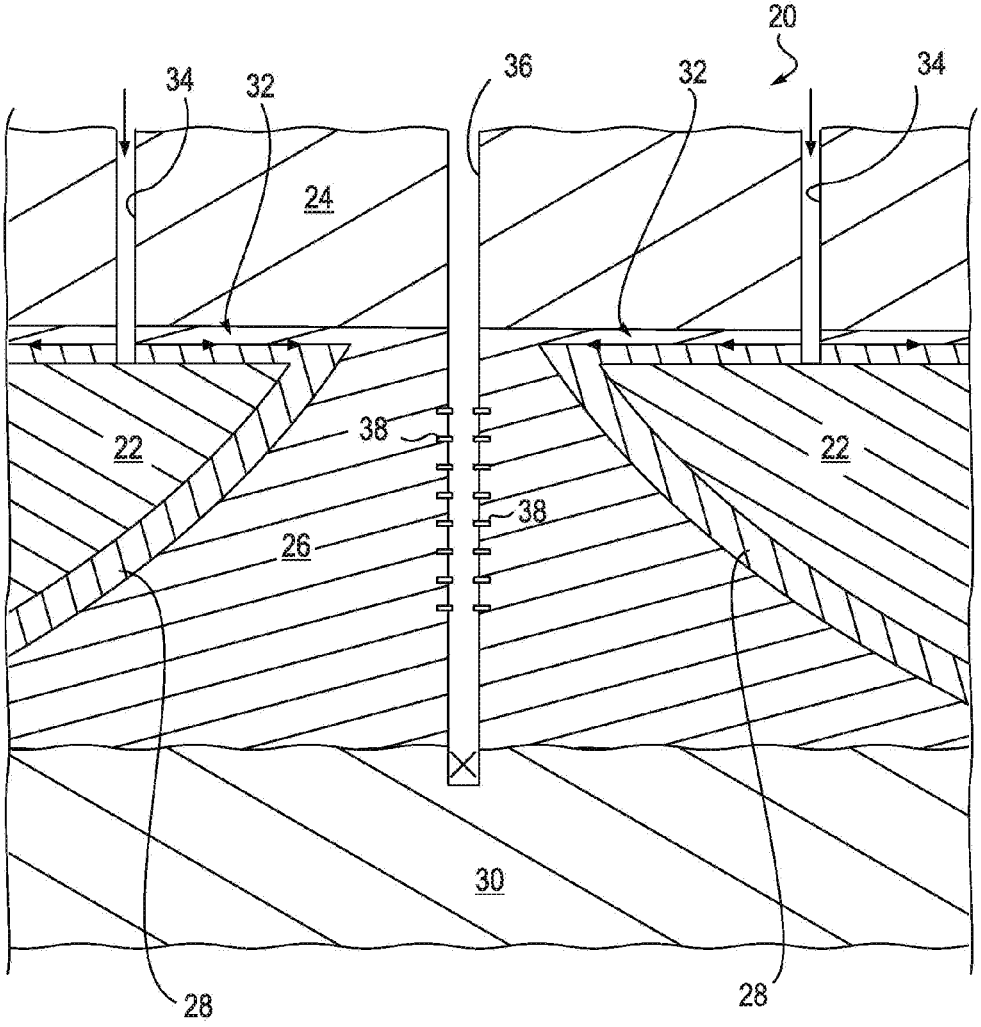
20
34
32
36
32
34
24
22
38
38
22
26
30
28
28

METHOD AND SYSTEM FOR PRODUCING HYDROCARBONS FROM A HYDRATE RESERVOIR USING A SWEEP GAS

This application claims the benefit of provisional Application Ser. No. 61/141,877, filed Dec. 31, 2008.

FIELD OF THE INVENTION

The present invention relates to the production of hydrocarbons from subterranean hydrocarbon containing hydrate reservoirs.

BACKGROUND OF THE INVENTION

Natural gas hydrates (NGH or clathrate hydrates of natural gases) form when water and certain gas molecules are brought together under suitable conditions of relatively high pressure and low temperature. Under these conditions, the 'host' water molecules will form a cage or lattice structure capturing a 'guest' gas molecule inside. Large quantities of gas are closely packed together by this mechanism. For example, a cubic meter of methane hydrate contains 0.8 cubic meters of water and typically 164 but up to 172 cubic meters of methane gas. While the most common naturally occurring clathrate on earth is methane hydrate, other gases also form hydrates including hydrocarbon gases such as ethane and propane as well as non-hydrocarbon gases such as carbon dioxide ($CO_2$) and hydrogen sulfide ($H_2S$).

NGH occur naturally and are widely found in sediments associated with deep permafrost in Arctic environments and continental margins at water depths generally greater than 500 meters (1600 feet) at mid to low latitudes and greater than 150-200 meters (500-650 feet) at high latitudes. The thickness of the hydrate stability zone varies with temperature, pressure, composition of the hydrate-forming gas, underlying geologic conditions, water depth, and other factors.

World estimates of the natural gas potential of methane hydrate approach 700,000 trillion cubic feet—a staggeringly large figure compared to the 5,500 trillion cubic feet that make up the world's currently proven gas reserves.

Most of the methane hydrate research to date has focused on basic research as well as detection and characterization of hydrate deposits. Extraction methods that are commercially viable and environmentally acceptable are still at an early stage. Developing a safe and cost effective method of producing methane hydrates remains a significant technical and economic challenge for the development of hydrate deposits.

A growing body of work indicates that when a hydrate reservoir is produced, dissociation fronts will form on both the bottom and top of the hydrate layer. The appearance of a dissociation front on the bottom of the hydrate layer is because the deeper parts of the earth are typically hotter than the shallower parts. Hydrate dissociation is a strongly endothermic process (i.e., the hydrate must draw in heat from the surrounding environment). Further, the earth below the hydrate reservoir has its heat continuously provided and replaced by even hotter layers below; thus providing an essentially endless supply of new heat to the hydrate reservoir.

The appearance of a dissociation front on the top of the hydrate layer is a less obvious phenomenon because the geothermal temperature is typically cooler than that of the hydrate layer, but given the strongly endothermic nature of hydrate dissociation it becomes evident that even heat from the earth above the hydrate layer will be drawn into the hydrate reservoir. The key difference is that the shallow earth above the hydrate layer is measurably cooler than the deep earth below the hydrate reservoir. In addition, the shallow earth above the hydrate layer (whether deep ocean floor sediments or arctic permafrost) is being continuously cooled from above. Any heat, once it has been pulled into the hydrate layer below, will not easily be replaced.

It is worth noting that the dissociation fronts on both the top and bottom of the hydrate layers are nearly horizontal and quickly move out to great radial distances from the wellbore. After the initial dissociation phase when the dissociation fronts are established, the disassociation fronts then slowly work their way towards each other, eventually meeting somewhere in the middle of the hydrate deposit, at which point the hydrate reservoir will be completely dissociated.

Produced gas in any reservoir will rise up due to its natural buoyancy. Produced gas from hydrate dissociation will tend to flow upwards and pool at the top of the hydrate reservoir. The relative initial coolness and lack of replacement heat from the shallow earth above the hydrate reservoir results in a condition whereby the 'head space' gas is very cool and easily reconverts to hydrates at the slightest pressure drop.

Consequently, even small pressure drops (for example, the pressure drop associated with the necessarily relatively lower pressure at a producer well that enables gas to flow toward the wellbore) can cause sufficient consequent temperature drop due to Joule-Thompson effects that dissociated methane gas from hydrates will be caused to reform hydrates in the upper 'head space', particularly near the wellbore. This formation of hydrates can essentially block or restrict further production.

Left unmitigated, the only solutions have been to reduce the pressure drop (i.e. lower the production rate) to a point where hydrate reformation will not occur or add heat-generating features to the production well bore. The negative economic consequences of such techniques are self-evident.

SUMMARY OF THE INVENTION

A method for producing hydrocarbons from a hydrocarbon containing hydrate reservoir is disclosed. The method includes providing at least one producer well in fluid communication with a producing facility and with a hydrocarbon containing hydrate reservoir. The hydrate reservoir is in fluid communication with a head space disposed above the hydrate formation. The head space contains disassociated hydrocarbons and water. The method further comprises sweeping a sweep gas across the head space to remove the disassociated gas and water from the hydrate reservoir and to transport the disassociated gas and water to the at least one producer well. The producer well ideally transports the disassociated hydrocarbons and water to a production facility.

Preferably, the sweep gas is introduced into the head space utilizing one or more injector wells. Injection of the sweep gas will establish a pressure gradient to help drive the dissociated gas to the producer well. Care must be taken to prevent the injection pressure of the sweep gas from becoming too high relative to the reservoir head space temperature regime to prevent formation of new hydrates.

The sweep gas may be naturally hot or artificially heated prior to introduction into the head space or not heated. The additional heat provided by the sweep gas will help inhibit the reformation of hydrates in the disassociated head space gas. This reformation of hydrates might otherwise create blockages in the reservoir which would limit the production rate from producer well. Heated sweep gas will also increase the dissociation rate of the hydrate reservoir. Non-limiting examples of sweep gases may include natural gas, methane, nitrogen or a mixture of the gases.

A system for producing hydrocarbons from a hydrocarbon containing hydrate formation is also described. The system comprises a subterranean hydrocarbon containing hydrate formation, a head space, a producer well and a conduit introducing a sweep gas into the head space. The hydrocarbon containing hydrate formation ideally contains hydrocarbons such as methane, ethane and propane. The head space is disposed above and is in fluid communication with the hydrate reservoir. The head space contains disassociated gas and water from the hydrate reservoir. The producer well is in fluid communication with and produces disassociated gas and water from the hydrate reservoir and the head space to a production facility. The conduit provides a sweep gas to the head space to assist in transporting the disassociated gas and water to the producer well. Optionally, the sweep gas may also assist in heating the disassociated gas and water. The conduit may include at least one injector well. The at least one injector well may include insulated tubing for preventing heat from the sweep gas from escaping to a surrounding subterranean formation or sea.

BRIEF DESCRIPTION OF THE DRAWINGS

These and other objects, features and advantages of the present invention will become better understood with regard to the following description, appended claims and accompanying drawing where:

The FIGURE is a schematic view of a pair of injector wells introducing a "sweep gas" into the head space of a hydrate reservoir to add heat and/or to establish a pressure gradient in the disassociated gas in the head space to drive the disassociated gas to the producer well. The sweep gas assists in enhancing the hydrate dissociation rate and inhibits the reformation of hydrates that might otherwise slow production of the disassociated gas into a producer well.

DETAILED DESCRIPTION

The present invention relates generally to a method and system whereby one or more injector wells are used to introduce a 'sweep gas' into the head space of a hydrate formation and drive all newly-dissociated gas to a producer well. The 'sweep gas' can either act to establish a pressure gradient to physically push the dissociated gas, or could be used to provide heat to the head space, or both. This results in significant improvements in production rates of the overall hydrate reservoir. The sweep gas could be any of a number of gasses or combination of gasses including, but not limited to, hot natural gas, methane or nitrogen. Hot natural gas (for example from nearby conventional gas production) would be a particularly favorable sweep gas because its use would not result in dilution of the hydrate gas, and little or no additional heating would be required. A relatively small amount of such sweep gas would leverage into significant hydrate reservoir production rates.

By way of example, and not limitation, one exemplary embodiment is shown in The FIGURE. Alternative configurations could include utilizing one or more injector wells and one or more producers in any of variety of arrangements including alternating or aligned grid patterns.

The FIGURE depicts a system 20 for producing hydrocarbons from subsurface formations. System 20 includes a hydrate formation 22 that contains hydrocarbons entrained in hydrates. Ideally, the hydrocarbons include methane, ethane and propane which are released or disassociated from the hydrates when the proper temperatures and pressures are induced in the hydrate formation. Above hydrate formation 22 is an overlaying stratigraphic layer 24 such as rock or permafrost which provides a top seal and which is generally cooler than the in-situ hydrate formation 22 due to normal geothermal gradients, but which provides limited heat to support the endothermic dissociation of hydrates to the top of hydrate formation 22 once production begins. A generally hour glass shaped disassociated zone 26 in which hydrates have been disassociated into water and gas is located radially exterior to the producer well 36 and radially interior to hydrate formation 22. Located intermediate hydrate formation 22 and disassociated zone 26 is a disassociation front 28 in which hydrates are disassociated into components including water and natural gas among others. Located beneath hydrate formation 22 and disassociated zone 26 is a supporting stratigraphic layer 30. Generally, supporting stratigraphic layer 30 is at a higher temperature than is hydrate zone 22 due to geothermal gradients as supporting stratigraphic layer 30 is closer to the earth's core. Supporting stratigraphic layer 30 provides relatively larger quantities of heat to the bottom of hydrate formation 22 once production begins. Supporting stratigraphic layer 30 may contain free gas (i.e. comprising a Class 1 hydrate reservoir system), or a mobile aquifer (i.e. comprising a Class 2 hydrate reservoir system) or may act as a sealing feature (i.e. comprising a Class 3 hydrate reservoir system).

In this example, a pair of injector wells 34 introduces a sweep gas, heated or not heated, into a head space disposed above hydrate formation 22. Configurations of producer and/or injector wells could include one or more injectors and one or more producers in any of a variety of arrangements including alternating or aligned grid patterns. Gas and water disassociated from hydrate formation 22 is collected and produced by a producer well 36. Producer well 36 has perforations 38 in production tubing which allows fluid communication between hydrate formation 22 and surface where production facilities (not show) process produced fluids. The additional heat provided by the heated sweep gas helps prevent disassociated gas from reforming into hydrocarbon containing hydrates and increases the dissociation rate at the top of the hydrate formation 22. Injection of the sweep gas in the injector wells 34 will create a pressure gradient that will help drive the dissociated gas to the producer well 36. Care must be taken to control the injection pressure from becoming too high, which would cause hydrates for form in the head space.

A method is disclosed wherein one or more injector wells are used to introduce a 'sweep gas' into the head space 32. The sweep gas drives newly-dissociated gas to a producer well. The 'sweep gas' can either act to physically push the produced gas, or could be used to provide heat, or both. This influence provided by the sweep gas would result in significant improvements in production rates of the overall hydrate reservoir. The sweep gas could be any of a number of gasses or combination of gasses including, but not limited to, hot natural gas, methane or nitrogen. Naturally hot natural gas (for example from nearby conventional gas production) would be a particularly favorable sweep gas because its use would not result in dilution of the hydrate gas, and little or no additional heating would be required. Depending on geologic and other features, a relatively small amount of such sweep gas would leverage into significant hydrate reservoir production rates.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method for producing hydrocarbons from a hydrocarbon reservoir containing a hydrate formation, the method comprising:

(a) providing a producer well in fluid communication with a producing facility and with a hydrocarbon reservoir containing a hydrate formation being in fluid communication with a head space disposed above the hydrate formation and containing disassociated hydrocarbons and water; and (b) sweeping a sweep gas across the head space to remove the disassociated hydrocarbons and water from the hydrate formation and to transport the disassociated gas and water to the producer well.

2. The method of claim 1 further comprising:

introducing the sweep gas into the head space utilizing an injector well.

3. The method of claim 2 further comprising:

introducing the sweep gas into the head space utilizing a plurality of injector wells arranged about the producer well.

4. The method of claim 2 wherein:

the sweep gas is heated prior to being introduced into the injector well.

5. The method of claim 1 wherein:

the sweep gas is selected from the group consisting of one or more of natural gas and methane and nitrogen.

6. The method of claim 1 wherein:

the sweep gas is natural gas.

7. The method of claim 1 wherein:

the sweep gas is methane.

8. The method of claim 1 wherein:

the sweep gas is nitrogen.

9. The method of claim 1 wherein:

the sweep gas adds heat to head space;

whereby the introduction of heat into the head space allows the producer well to produce at a higher rate of production than if heated sweep gas were not provided.

10. A system for producing hydrocarbons from a hydrocarbon containing hydrate formation, the system comprising:

a subterranean hydrocarbon containing hydrate reservoir;

a head space disposed above and in fluid communication with the hydrate reservoir, the head space containing disassociated gas and water from the hydrate reservoir;

a producer well in fluid communication with and which produces disassociated gas and water from the hydrate reservoir and the head space to a production facility; and a conduit which provides a sweep gas to the head space to assist in transporting the disassociated gas and water to the producer well.

11. The system of claim 10 wherein:

the conduit providing the sweep gas includes at least one injector well.

12. The system of claim 11 wherein:

the conduit providing the sweep gas includes a plurality of injector wells.

13. The system of claim 11 wherein:

the at least one injector well includes insulated tubing for preventing heat from the sweep gas from escaping to a surrounding subterranean formation or sea.

14. The system of claim 11 wherein:

the sweep gas is selected from at least one of natural gas, methane, and nitrogen.

* * * * *